US009933114B2

(12) United States Patent
Thiessen

(10) Patent No.: US 9,933,114 B2
(45) Date of Patent: Apr. 3, 2018

(54) INTELLIGENT CNG FUEL DISTRIBUTOR

(71) Applicant: Bradley H. Thiessen, Garland, TX (US)

(72) Inventor: Bradley H. Thiessen, Garland, TX (US)

(73) Assignees: Bradley H. Thiessen, Dallas, TX (US); Independence Fuel Systems L.L.C., Longview, TX (US)

( * ) Notice: Subject to any disclaimer, the term of this patent is extended or adjusted under 35 U.S.C. 154(b) by 561 days.

(21) Appl. No.: 14/499,080

(22) Filed: Sep. 26, 2014

(65) Prior Publication Data

US 2015/0083273 A1 Mar. 26, 2015

Related U.S. Application Data

(60) Provisional application No. 61/882,893, filed on Sep. 26, 2013.

(51) Int. Cl.
*B65B 1/04* (2006.01)
*F17C 5/06* (2006.01)

(52) U.S. Cl.
CPC ..... *F17C 5/06* (2013.01); *F17C 2205/0146* (2013.01); *F17C 2205/0326* (2013.01); *F17C 2221/033* (2013.01); *F17C 2223/0123* (2013.01); *F17C 2223/036* (2013.01); *F17C 2227/0157* (2013.01); *F17C 2227/043* (2013.01); *F17C 2250/032* (2013.01); *F17C 2265/065* (2013.01);

(Continued)

(58) Field of Classification Search
CPC ..... F17D 1/02; F17D 1/04; F17D 1/07
See application file for complete search history.

(56) References Cited

U.S. PATENT DOCUMENTS 5,259,424 A 11/1993 Miller et al.
5,538,051 A * 7/1996 Brown ..... F17C 5/06 123/525
2006/0174965 A1 8/2006 Hobbs (Continued)

OTHER PUBLICATIONS

International Preliminary Report on Patentability issued by the International Bureau on behalf of the International Searching Authority in co-pending PCT application No. PCT/US2014/057906 dated Apr. 7, 2016.

(Continued)

*Primary Examiner* — Jason K Niesz
(74) *Attorney, Agent, or Firm* — Baker & McKenzie LLP

(57) ABSTRACT

According to the described embodiments, an intelligent compressed natural gas distributing system is inserted into an existing compressed natural gas fueling station. A means to distribute compress natural gas associated with designated primary dispenser as determined by fueling situations. The system maintains a high differential of pressure during fueling as to decrease time of fueling by means of control valves on the dispenser lines. Within the system, at least one of the dispenser line is determined to be the primary active dispenser and is fueled directly from a compressor when pressure is detected under optimal threshold. The subordinate lines are subject to a bypass in which fueling is directly sourced from a high-pressure storage and receiving excess gas from the primary active dispenser.

11 Claims, 5 Drawing Sheets

(52) U.S. Cl.
CPC ..... *F17C 2270/0171* (2013.01); *F17C 2270/0176* (2013.01); *F17C 2270/0178* (2013.01); *F17C 2270/05* (2013.01)

(56) References Cited

U.S. PATENT DOCUMENTS

| | | | |
|---|---|---|---|
| 2007/0051423 | A1 | 3/2007 | Handa |
| 2008/0000542 | A1 | 1/2008 | Cohen et al. |

OTHER PUBLICATIONS

International search report and written opinion of the international searching authority for co-pending PCT application No. PCT/US2014/057906 dated Jan. 21, 2015.

* cited by examiner

INTELLIGENT CNG FUEL DISTRIBUTOR

CROSS-REFERENCE TO RELATED APPLICATIONS

This application claims priority to U.S. Provisional Patent Appl. No. 61/882,893, filed Sep. 26, 2013, the contents of which are hereby incorporated by reference herein for all purposes.

FIELD OF ACTIVITY

Disclosed embodiments herein relate generally to fueling of compressed natural gas into vehicle gas tanks or other portable tanks brought to a fueling stations, and more particularly to systems to efficiently maintain high differential of pressure in multiple dispensers of compressed natural gas fueling situations.

BACKGROUND

Natural gas is a fast growing segment in the alternative fuel market for transportation in the United States and in other countries that have a surplus of natural gas. It is an alternative fuel that replaces gasoline, diesel and/or blends with diesel to power automobiles, pickups, light to heavy trucks, busses and high horsepower applications such as oil field drilling operations. Compressed natural gas (CNG) is dispensed to vehicles or other portable tanks after it has been stored in pressure vessels or it can be directly filled from the CNG compressors.

Compressed natural gas is not dispensed by pumping gas from a liquid reservoir like traditional gasoline and diesel pumps. Instead, CNG fueling stations dispense fuel under very high pressures and use pressure differentials to move the gas; gas flows from an area of higher to lower pressure.

The most typical configuration of a "fast fill" CNG station uses one or more compressor(s) to fill vehicles or other portable tanks and supplements the filling operation with a cascading storage through a priority panel. The priority panel is a network of tubing and valves plumbed together that receive gas from the compressor(s) and distributes CNG to storage, from storage to dispenser, or directly from compressor to dispenser according to the controls applied. A cascading storage system will typically have three banks of pressure (high, middle, and low). When the pressure falls below certain presets within the storage banks, the priority panel distributes CNG to fill each bank of the cascading storage system. When the pressure falls too low in the high bank storage, the priority panel will also close off the storage banks and distribute CNG directly from the compressor to the fuel dispensers through the high bank fill manifold.

The cascading storage system allows each dispenser to pull CNG first from the low bank, then switch to the middle bank, and lastly switch to the high bank to maintain the highest differential of pressure allowing for complete fills without starting a compressor for every vehicle filling. A site controller can be utilized to manage the function of the priority panel as well as control each compressor in a system. Each dispenser can take fuel from each bank of storage simultaneously, and are all plumbed in the high, middle, and low CNG distribution manifolds between the priority panel and the dispensers.

The issue with this type of system is that all of the dispensers in a system share a common bank of storage and direct fill. So when more than one vehicle is filling up on the system at the same time, the vehicle or other portable gas tank with the lowest gas pressure gets CNG the fastest while the vehicle or other portable gas tank closest to a complete fill (and hence with higher pressure) will slow or stall until the lower pressure vehicle or tank fills with enough CNG to equalize the pressure.

An example illustrating the multiple vehicle filling problem is when a first vehicle—say a large truck—pulls in and begins fueling, pulling a large volume of CNG from the cascading system before a compressor comes online to fill the storage or truck directly. As the first vehicle is still filling, another vehicle (or other gas tank is brought in) pulls in and begins fueling. When the two vehicles begin flowing gas from the high bank storage, the dispenser connected to the vehicle with greater pressure in the fuel tank will stall until the pressure in the tanks equalize. After the fuel tanks equalize they will be sharing CNG flow and the fill volume is split in half. If yet another vehicle begins fueling at the same time, the fill volume is effectively cut in third, which results in long fill times during peak demand periods.

Lacking in prior art is a way for distribution of CNG in fueling stations to maintain high differential of pressure through prioritized individual dispensers with multiple fueling vehicles.

SUMMARY OF THE EMBODIMENTS

Disclosed is a system for efficient fueling of compressed natural gas vehicles. Specifically disclosed, is an Intelligent CNG Distributor (ICD) that receives and interprets signals from the fuel dispensers, storage, and site controllers to control the flow of CNG, specifically including the flow of CNG from the high bank and direct fill CNG line/direct fill gas line.

According to the described embodiments, the disclosed ICD allows dispensers to draw CNG from the high bank storage and the direct fill line simultaneously. The ICD distributes gas through the high bank manifold and prioritizes direct fill to individual dispensers while maintaining the highest differential of pressure without stalling a dispenser, resulting in reduced fill times and complete fueling.

The foregoing has outlined preferred and alternative features of various embodiments of the disclosed principles so that those skilled in the art may better understand the detailed description that follows. Additional features will be described hereinafter that form the subject of the claims appended herein. Those skilled in the art should appreciate as a basis for designing and modifying other structures for carrying out the same purposes of the disclosed principles. Those skilled in the art should also realize that such equivalent constructions do not depart from the spirit and scope of the disclosed principles.

BRIEF DESCRIPTION OF THE DRAWINGS

The disclosed principles may be further understood from the following description in conjunction with the appended drawings. It is emphasized that various features may not be drawn to scale. In the drawings.

DETAILED DESCRIPTION

Figure 1:
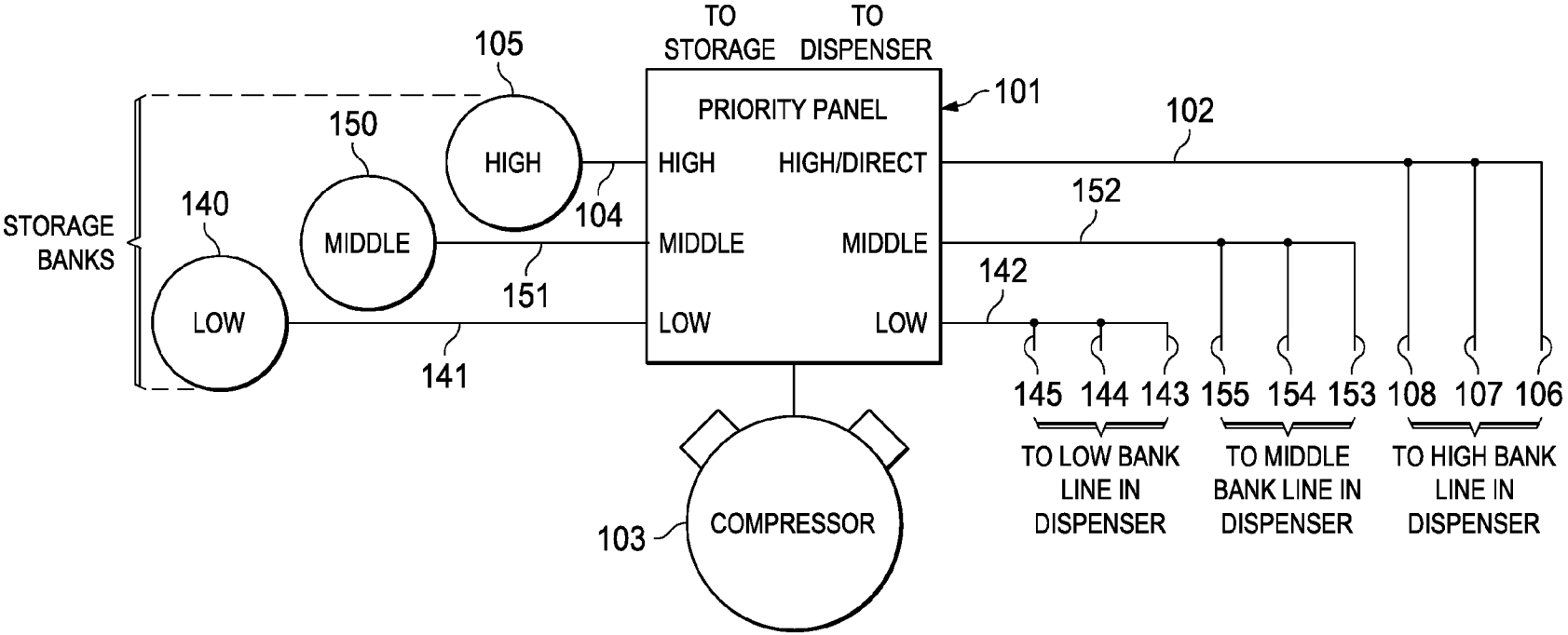
FIG. 1 is a diagram illustrating typical CNG fast fill station component configuration.

As shown in FIG. 1, the normal flow of gas to the dispenser flows from storage through the priority panel, then through a gas manifold system, and then to the dispenser in a fast fill station. This CNG (gas) flow is known in the prior art, and in exemplary embodiments of the present application this general direction of flow is not changed, although aspects of the presently disclosed embodiments could also be described to flows designed in a different way from the exemplary approach of FIG. 1.

FIG. 1 describes a typical CNG fueling station. High bank lines 106,107,108 are connected to the dispenser, which outputs CNG during the fueling process. Direct high-pressure line 102 connects the priority panel 101 to the high bank line 106,107,108. The CNG sourced from direct high-pressure line 102 in this embodiment disperses equally between the three high bank lines 106,107,108. The priority panel 101 determines whether CNG is sourced from the high bank storage 105 or directly from the compressor 103 when pressure falls below a preset value. The direct high-pressure line 102 feeds the output fueling process by either the high bank storage 105 or direct fill from the compressor 103. Fueling direct from the high bank storage 105 is connected to the priority panel 101 by means of a high bank storage line 104. The high bank storage line 104 feeds stored high pressure CNG to the priority panel 101 to the high bank lines 106,107,108 during the fueling process.

Also shown for contextual purposes in FIG. 1 are the low and middle bank storage tanks 140,150 connected by respective low and middle bank storage lines 141,151. Direct high pressure lines from the low and middle storage banks 142,152 that correspondingly feed the sets of low bank lines 143,144,145 and middle bank lines 153,154,155. The functioning of these different banks is a "cascading system" as is understood in the prior art.

The typical fast fill station has no mechanism by which primary dispensers can be utilized, the lines connecting the priority panel 101 to the high bank dispenser outputs 118, 119,120 have no control valves present which cannot be utilized to shut off flow in response to lowered pressure, high bank solenoid actuation or specified number of handle lifts.

Figure 2:
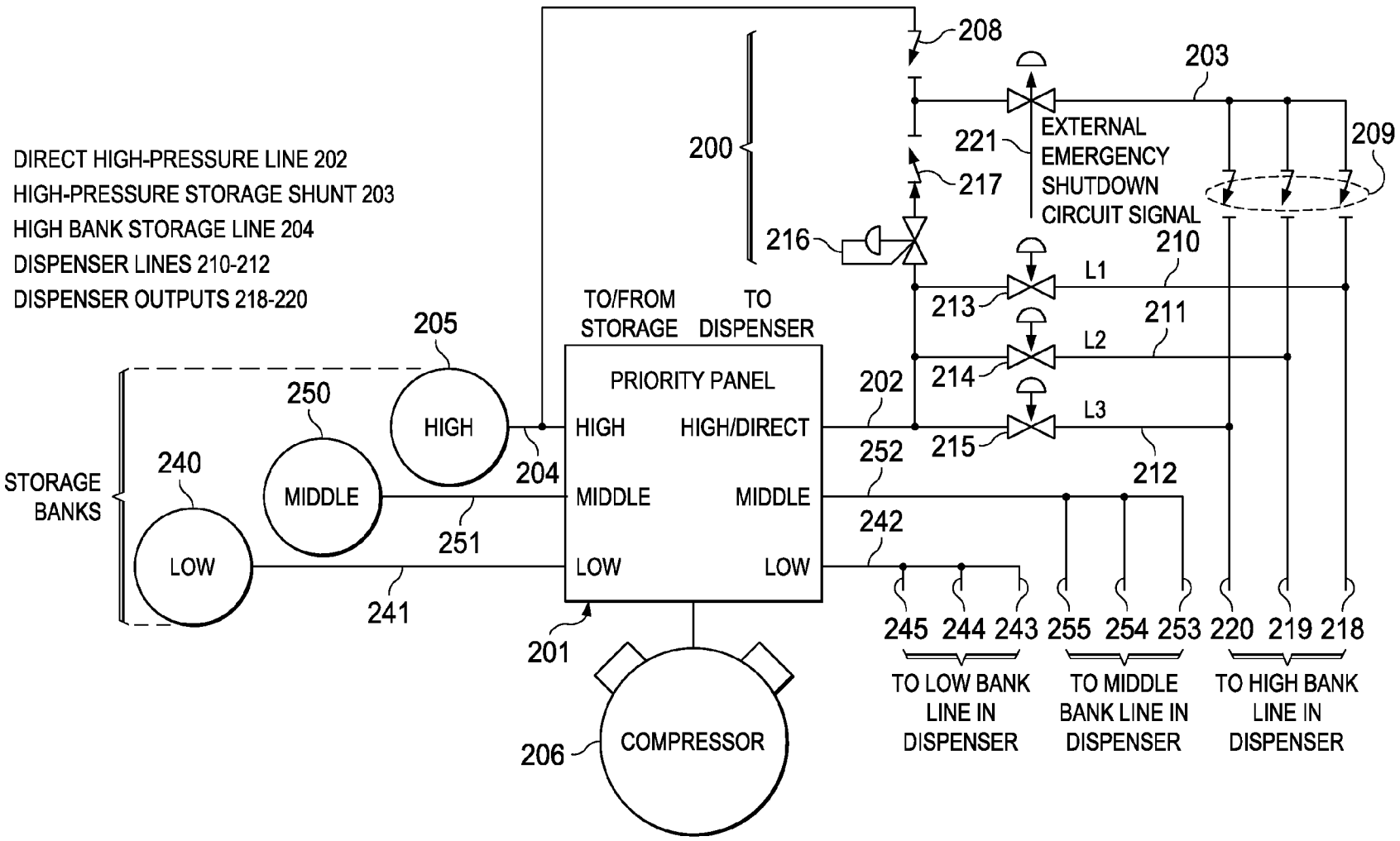
FIG. 2 is a diagram illustrating an the installation of the presently disclosed ICD gas manifold installed as an example at a fast fill station of the configuration shown in FIG. 1.

In comparison with FIG. 1, FIG. 2 includes the ICD components disclosed in the present application in order to improve the filling performance of a CNG filling station. Thus, for example, FIG. 2 addresses problems associated with prior art systems in which all of the dispensers in a system share a common bank of storage tanks and share direct fill lines. Accordingly, FIG. 2 describes a CNG fueling station with ICD components installed. High bank lines 218,219,220 are connected to the dispensers, which output CNG during the fueling process. Direct high-pressure line 202 connects the priority panel 201 to the high bank dispenser lines 218,219,220. The CNG sourced from direct high-pressure line 202 in this embodiment disperses equally between the three high bank dispenser lines 218,219,220. The priority panel 201 determines whether CNG is sourced from the high bank storage 205 or directly from the compressor 206 when pressure falls below a preset value. High bank storage 205 is composed of a vessel in which high pressure CNG can be stored. The direct high-pressure line 202 feeds the output fueling process by either the high bank storage 205 or direct fill from the compressor 206. Fueling direct from the high bank storage 205 is connected to the priority panel 201 by means of a high bank storage line 204. The high bank storage line 204 feeds stored high pressure CNG to the priority panel 201 to the high bank lines 218,219,220 during the fueling process.

Direct high-pressure line 202 is connected to the dispenser lines 210,211,212 that connect to the high bank dispenser lines 218,219,220 sourced by CNG from the priority panel 201. Control valves 213,214,215 control flow of CNG from the direct high-pressure line 202 to the dispensers. Control valves 213,214,215 can control the flow of CNG during direct fill conditions, rerouting CNG to the primary dispenser lines 210,211,212. High-pressure storage bypass line 203 receives CNG from both the high bank storage line 204 and excess CNG from direct high-pressure line 202. The high-pressure storage bypass includes check valves 209. Check valves 209 are present to allow flow of CNG towards the dispenser when CNG is flowing from the high bank storage 205 thru the high-pressure storage bypass. Added to the high-pressure storage bypass is an external emergency shutdown valve 207 that is associated with the external emergency shutdown circuit signal 221. A separate backpressure valve 216 and check valve 217 may be installed within the ICD to flow excess gas produced by the compressor 206 from dispenser lines 210,211,212 to the high-pressure storage bypass 203.

Thus, for example, when comparing the presently disclosed embodiment, among other improvements described herein, the high bank storage line 104 in FIG. 1 does not have the addition of check valve 208 of the ICD in order to supplement CNG flow to the high-pressure storage bypass 203 to thereby supplement the distribution outputs 218,219, 220. In other words, the presently disclosed embodiment illustrates an ICD installed on the previously described fast fill station, including the ICD components 200 comprised of control, check, and backpressure valves, and the stainless steel tubing installed between the priority panel 201 and the designed gas manifold system on the direct high-pressure dispenser line 202.

As with the description of FIG. 1, also shown here for contextual purposes are the low and middle bank storage tanks 240,250 connected by respective low and middle bank storage lines 241,251. Direct high pressure lines from the low and middle storage banks 242,253 correspondingly feed the sets of low bank lines 243,244,245 and middle bank lines 253,254,255. The functioning of these different banks in the presently described embodiment can be adapted to work in coordination with the implementation of the presently disclosed high bank ICD elements system.

The further operation of the elements shown in FIG. 2 will be described below in context of the exemplary embodiments of FIG. 3 and FIG. 4. For the context of these described embodiments, the embodiments will be further described with respect to the high bank storage and distribution lines, but again, the principles disclosed herein can be applied to the low and mid banks.

Figure 3:
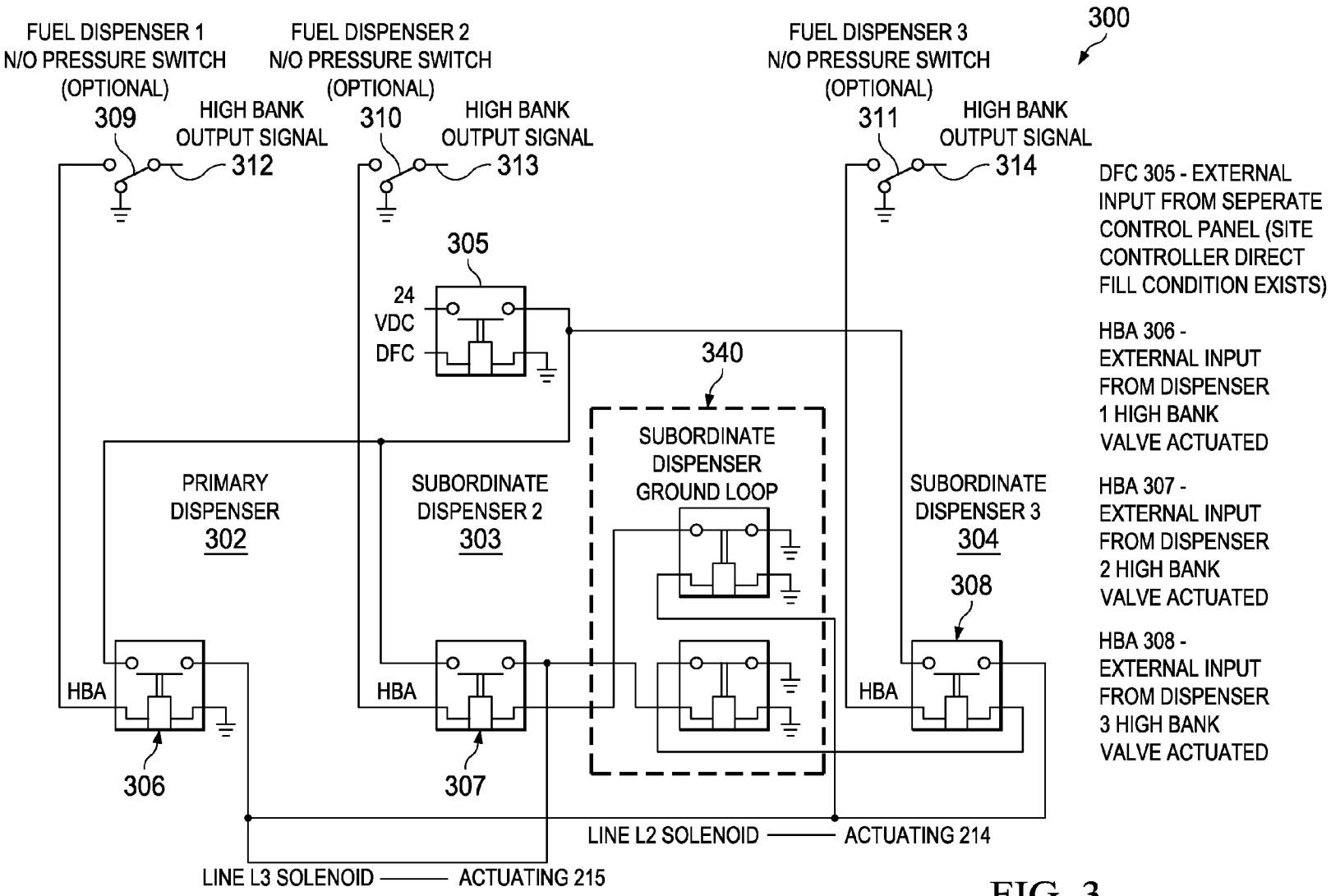
FIG. 3 is a presently disclosed ICD relay system for identifying and prioritizing fuel loads in a first configuration.

FIG. 3 illustrates ICD control circuitry 300 that receives various signals from the physical components of the CNG filling station and provides control inputs to the various physical components in the CNG filling station in order to effect the physical improved performance of the filling station in light of the improved approaches disclosed in the embodiments herein.

In the presently described embodiments, the ICD control circuitry 300 receives signal inputs from the fuel dispensers, which can include handle lift signals (not illustrated), high bank actuation 312,313,314, and fill pressures (e.g., 3600-3800 psig) determined by the fuel dispenser N/O pressure switch 309,310,311. The ICD control circuitry 300 will also receive inputs from the site controller 502 (or another source—see, e.g., FIG. 5, below) indicating priority panel 201 actions to perform direct fill active/inactive decisions and interprets these inputs to determine when to open and close valves 213,214,215 on the dispenser lines 210,211,212 to control the timing and prioritizing the flow of direct fill gas.

With the ICD gas manifold 200 installed (see FIG. 2), high bank gas can be sourced from the direct high-pressure dispenser line 202 coming from the priority panel 201 and the high-pressure storage bypass or shunt 203 coming from the high bank storage line 204 between the high bank storage vessel 205 and the priority panel 201. This allows gas to be sourced from both high bank storage 205 and directly from the compressor 206 simultaneously.

On the high-pressure storage bypass 203, there may be installed a fail/safe closed emergency shutdown valve 207 that may be tied into the existing station's emergency shutdown valve circuit 221. The CNG station is equipped with a series of emergency shutdown switches. The emergency shutdown valve circuit 221 from the ICD is integrated into the existing emergency shutdown switches by, e.g., externally driven electrical, pneumatic, and/or optical inputs to the ICD control.

In the present embodiment, a check valve 208 may be installed before the fail/safe closed emergency shutdown valve 207 on the high-pressure storage bypass 203. The check valve 208 allows CNG to flow from the high bank storage line 204 to the high-pressure storage bypass 203. Check valves 209 may be installed on each line sourcing gas from the high-pressure storage bypass 203. The fail/safe closed emergency shutdown valve 207 cuts off the flow of gas in case of emergency or failure. The check valves 208 stops higher pressure gas from the back pressure valve 216 from flowing back to high pressure storage 205. Check valves 209 are installed to prevent higher pressure gas from flowing from the ICD lines 210,211, 212 to line 203 and out on all dispenser lines 218,219,220 eliminating potential for cross-flowing gas.

Within the ICD manifold 200, the gas supply from direct high-pressure dispenser line 202 enters the manifold and splits off into individual gas supply lines for each dispenser lines 210, 211, and 212. Dispenser lines 210, 211, and 212 flow gas from both the direct fill/high-pressure gas supply line 202 and high-pressure storage bypass 203. Lines 210, 211,212 have corresponding control valves 213,214,215 installed to control the source of gas. Control valves 213, 214,215 allow the flow of gas to go uninterrupted should a component of the ICD fail to operate properly. As the control valves 213,214,215 are not part of the emergency shutdown valve circuit 221, it is not generally necessary to close these valves in the event of an emergency shutdown. A separate backpressure valve 216 and check valve 217 may be installed within the ICD to flow excess gas produced by the compressor 206 from dispenser lines 210,211,212 to the high-pressure storage bypass 203. This allows each active line to maintain gas pressure under direct fill and to flow excess CNG to the high-pressure storage bypass 203 and to additional dispensers currently in use.

FIG. 3 further illustrates that the ICD control circuitry 300 receives electrical signals from the dispenser(s) high bank solenoid(s) 312,313,314 thru the N/O pressure switch 309, 310,311 and the "direct fill condition" or "DFC" signal from the system program controller 502. The control circuitry controls the ICD's control valves 213,214,215 and accordingly to prioritize CNG fueling. In described embodiments herein, several conditions may be met before the ICD system begins redirecting CNG.

Maintaining a high differential of pressure during CNG fueling is accomplished by prioritizing one of the individual dispenser lines (e.g., 210) by subordinating other dispenser lines to be secondary lines (e.g., 211,212) to maintain high pressure in the primary dispenser line 210. Within the ICD's control panel 201, any of the dispenser lines (one of 210, 211,212) can be designated a primary dispenser to receive CNG from the direct high-pressure dispenser line 202. At that point, all other dispensers (the other two of 210,211, 212) in the system are subordinate and can be prioritized accordingly. In the specific embodiments below, the dispenser line 210 will act as the primary dispenser, but each line 211 and 212 can be treated as a primary dispenser depending on which is designated as the primary dispenser by the ICD system program controller 520 (see FIG. 5).

A CNG distribution operation for primary dispenser 302 is shown in FIG. 3 and relies on a DFC signal from the system program controller 502 (see FIG. 5) that a direct fill conditions (DFC) exists. Exemplary conditions that might indicate such a determination might be as follows: pressure in the high bank storage 205 below a user-specified pressure threshold (e.g., 3600-3800 psig) or a predetermined number of dispenser handle lifts. Once the DFC signal is received, the DFC relay 305 closes, sending signal power to the open side of the high bank actuated relay 306,307,308.

From the primary dispenser 302, a signal identifying that the primary dispenser's high bank fill solenoid 312 is activated or the primary dispenser's high bank fill solenoid 312 is activated and pressure in the high bank line has fallen below a specific pressure (e.g., 3600-3800 psig) detected by the fuel dispenser N/O pressure switch 309. The signal power can be sent from the high bank solenoid 312 directly or from the high bank solenoid 312 through a pressure switch installed in the high bank line. The pressure switch will be closed at pressures below a specified pressure, e.g., 3600-3800 psig, and open above it. Once received, the high bank actuated relay 306 will close and send a signal (electrical, pneumatic, optical, or otherwise) to the control valves 214, 215 (see FIG. 2).

Thus, when all specified conditions have been met, the control valve solenoid 306 in the ICD control circuitry 301 will send a signal to close the control valves 214, 215 on dispenser lines 211 and 212, thereby shutting off the gas sourced from the direct high-pressure line 202 and allowing dispenser outputs 219 and/or 220 to source gas directly from high-pressure storage bypass 203 and receive excess gas from the back pressure valves connected between the ICD high bank/direct fill line 202 and high-pressure storage bypass 203. Direct fill gas as will continue to flow as normal in dispenser line 210 to the dispenser output 218.

Further shown in FIG. 3 is a subordinate dispenser ground loop 340 that operates as a secondary control to the subordinate dispensers 303,304 such that the subordinate dispensers' associated solenoids 307,308 are redundantly disabled by the grounding of the "downstream" side of their actuator connections as can be seen in the figure. This grounding is accomplished by the illustrated subordinate ground loop 340. As between subordinate dispensers, these will be allocated on a first-come, first-serve basis.

Figure 4:
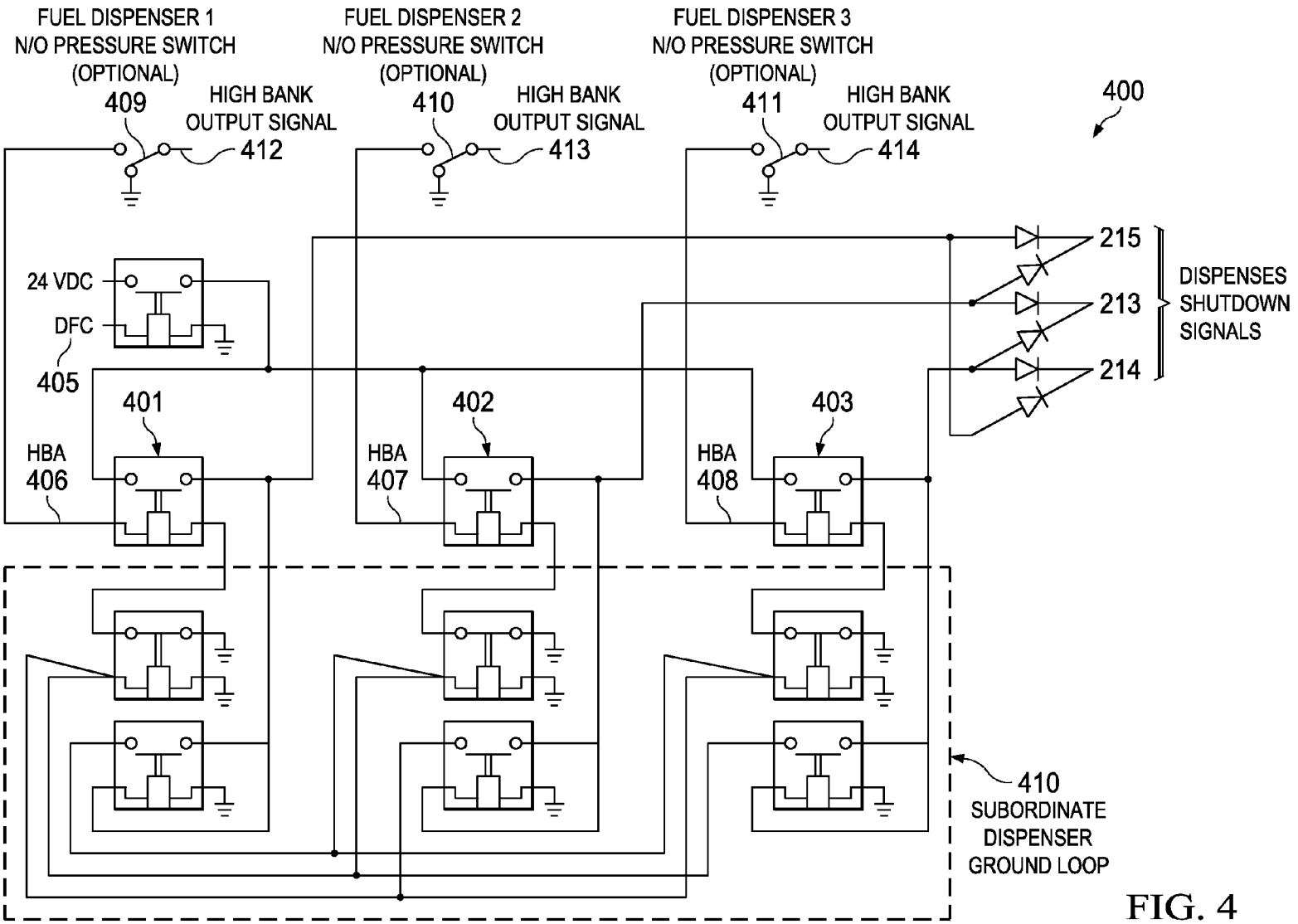
FIG. 4 is a presently disclosed ICD relay system for identifying and prioritizing fuel loads in a second configuration.

FIG. 4 embodies a "first come, first serve" system in that the active primary dispenser can be any of the fuel dispensers 401,402,403 for implementing high differential filling pressures in CNG stations.

CNG distribution operation for dispensers 401,402,403 are shown in FIG. 4 and relies on a signal 405 from the system program controller 502 (see FIG. 5) that direct fill conditions exist: Exemplary conditions that might indicate such a determination might be as follows: pressure in the high bank storage 205 below a user-specified pressure threshold (e.g., 3600-3800 psig) or a predetermined number of dispenser handle lifts. Once the DFC signal is received, the DFC relay 405 closes, sending signal power to the open side of the high bank actuated relay(s) 406,407,408. Each iteration of dispensers 401,402,403 as being the active primary dispenser will be described below.

From the active primary dispenser 401, a signal identifying that the primary dispenser's high bank fill solenoid 412 is activated and pressure in the high bank line has fallen below a specific pressure (e.g., 3600-3800 psig) detected by the fuel dispenser N/O pressure switch 409. The signal power can be sent from the high bank solenoid 412 directly or from the high bank solenoid 412 through a pressure switch 409 installed in the high bank line. The pressure switch will be closed at pressures below a specified pressure, e.g., 3600-3800 psig, and open above it. Once received, the high bank actuated relay will close and send a signal (electrical, pneumatic, optical, or otherwise) 406 to the control valve solenoid 401 in the ICD control circuitry 400, thus designating dispenser 401 as the active primary dispenser.

When all conditions have been met, the control valve solenoids in the ICD control circuitry 400 will send a signal to the ICD manifold's control valves 214 and/or 215, basically shutting down those dispensers in favor of line 210 for the first high bank dispenser line 210/218. Thus, dispenser solenoid 401 is the active primary solenoid for closing the control valves 214 and/or 215 on dispenser lines 211 and 212, thereby shutting off the CNG sourced from the direct high-pressure line 202 and allowing the dispenser outputs 219 and/or 220 to source CNG directly from high-pressure storage bypass 203 and receive excess CNG from the back pressure valve 217 connected between the ICD high bank/direct fill line 202 and high-pressure storage bypass 203. Direct fill CNG as will continue to flow as normal in dispenser line 210 to the dispenser output 218.

From the active primary dispenser 402, a signal identifying that the primary dispenser's high bank fill solenoid 413 is activated and pressure in the high bank line has fallen below a specific pressure (e.g., 3600-3800 psig) detected by the fuel dispenser N/O pressure switch 410. The signal power can be sent from the high bank solenoid 413 directly or from the high bank solenoid 413 through a pressure switch 410 installed in the high bank line. The pressure switch will be closed at pressures below a specified pressure, e.g., 3600-3800 psig, and open above it. Once received, the high bank actuated relay will close and send a signal (electrical, pneumatic, optical, or otherwise) 407 to the control valve solenoid 401 in the ICD control circuitry 400, thus designating dispenser 402 as the active primary dispenser. Once received, the high bank actuated relay will close and send a signal (electrical, pneumatic, optical, or otherwise) 407 to the control valve solenoid 401 in the ICD control circuitry 400, thus designating dispenser 401 as the active primary dispenser.

When all conditions have been met, the control valve solenoid(s) in the ICD control circuitry 400 can send a signal (electrical, pneumatic, optical, or otherwise) to the ICD manifold's control valves 213 and/or 215.

Dispenser 402 is the active primary dispenser closing the control valve(s) 213 and 215 on dispenser line(s) 210 and/or 212, shutting off the CNG sourced from the direct high-pressure line 202 and allowing dispenser outputs 218 and 220 to source CNG directly from high-pressure storage bypass 203 and receive excess CNG from the back pressure valve 217 connected between the ICD high bank/direct fill line 202 and high-pressure storage bypass 203. Direct fill CNG will continue to flow as normal in dispenser line 211 to the dispenser output 219.

When a handle lift in high bank output 414 is received, the DFC relay 405 closes and sends signal power to the open side of the high bank actuated relay 408 on dispenser 403. Handle lift signal from the high bank output 414 coincides with the high bank actuated relay 408 on dispenser 403, dispenser 403 being designated as the active primary dispenser. When the pressure in the high bank line 220 has fallen below a specific pressure as detected by pressure switch 411, a signal is sent identifying the active primary dispenser's high bank fill solenoid 414 is activated.

From the active primary dispenser 403, a signal identifying that the primary dispenser's high bank fill solenoid 414 is activated and pressure in the high bank line has fallen below a specific pressure (e.g., 3600-3800 psig) detected by the fuel dispenser N/O pressure switch 411. The signal power can be sent from the high bank solenoid 414 directly or from the high bank solenoid 414 through a pressure switch 411 installed in the high bank line. The pressure switch will be closed at pressures below a specified pressure, e.g., 3600-3800 psig, and open above it. Once received, the high bank actuated relay will close and send a signal (electrical, pneumatic, optical, or otherwise) 408 to the control valve solenoid 403 in the ICD control circuitry 400, thus designating dispenser 403 as the active primary dispenser.

When all conditions have been met, the control valve solenoid(s) in the ICD control circuitry will send a signal to the ICD manifold's control valve(s) 213 and/or 214.

Dispenser 403 is the active primary dispenser closing the control valve(s) 213 and/or 214 on dispenser line(s) 210 and/or 211 shutting off the CNG sourced from the direct high-pressure line 202 and allowing dispenser outputs 218 and 219 to source CNG directly from high-pressure storage bypass 203 and receive excess CNG from the back pressure valve 217 connected between the ICD high bank/direct fill line 202 and high-pressure storage bypass 203. Direct fill CNG will continue to flow as normal in dispenser line 212 to the dispenser output 220.

During primary dispenser conditions, CNG flow is prioritized to one of the output dispensers 218,219,220. The ICD manifold 200 as shown in FIG. 2 is not present in prior art. Specifically, a mechanism to maintain high differential of pressure is absent from the typical fast fill station as evidenced by FIG. 1.

Any control mechanisms to detect low levels of pressure (e.g., 3600-3800 psig in the embodiments described herein, or more narrowly, e.g., 3650-3750 psig, or more broadly, e.g., 3300-4100 psig) during CNG fueling situations to maintain high differential of pressure is wholly missing in prior art. The ICD system shown in FIG. 2 and the subsequent control circuitry shown in FIGS. 3 and 4 allows obtaining this high differential of pressure in order to efficiently fuel CNG vehicles during times of high use.

Figure 5:
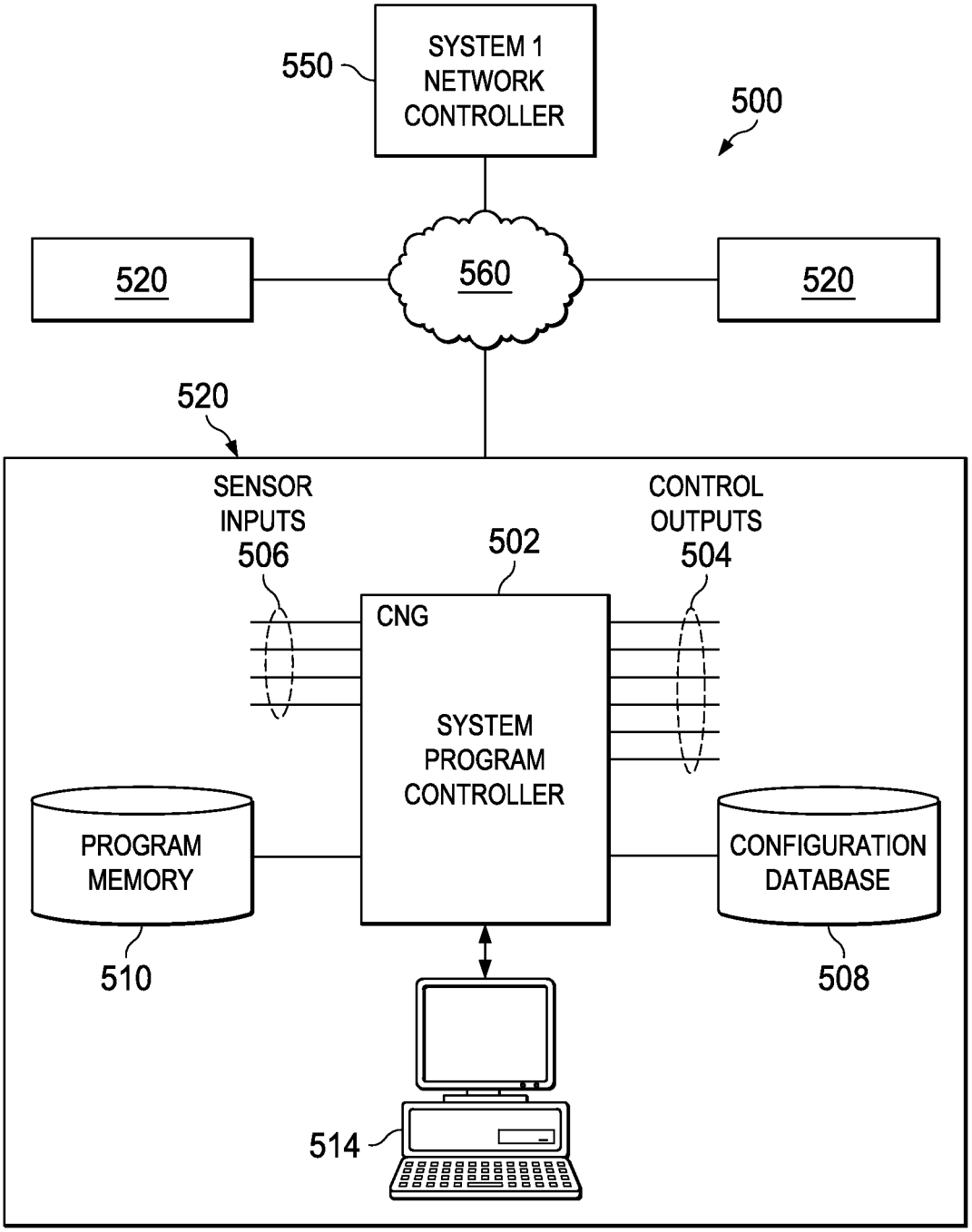
FIG. 5 is a schematic diagram for the processing and control circuitry for the disclosed system.

Further described in FIG. 5 is a overall system diagram 500 of the present disclosed embodiments, in which a CNG system programmable controller 502 is provided in order to provide control through control signals 504 of the high bank solenoid(s) 312-314 and/or 412-414, control valve solenoid(s) 213-215, or other control elements described herein by processing received sensor signals 506. By receiving the various sensor signals and executing control methods to effect control of the system elements described in the exemplary embodiments of FIGS. 2-4, the overall control system 520 of a CNG filling system can adaptively control various physical gas flow elements (e.g., valves) through the described physical actuators (e.g., solenoids).

The described CNG system programmable controller 502 is, for example, a microprocessor or other microcontroller running system commands stored in a computer readable medium or program memory 510. This program memory 510 enables the system programmable controller 502 to effect the communications and controls as described with regard to the exemplary embodiments described in FIGS. 2-4, although the controller 502 would be operable to implement other possible control and sensing embodiments according to design needs.

Further, the system 520 is configurable in accordance with the configuration database 508, such that it can be adapted according to various needs of a filling station at a given time or installation location.

Further this system 520 can be a part of a larger network 500 of systems located at one or more additional gas filling stations. In that example, a system/network controller 550 can be provided to communicate with multiple of the systems 520 through the network 560, which may be the internet. In all described instances, the communications with the various sensors and controls through signals 504, 506 can be effected through a microprocessor or microcontroller 502 running computer readable instructions stored in respective program memories 510 associated with those controllers 502.

A particular CNG configuration computer 514 can be provided and associated with the control system 520 in order to configure the various decision parameters that are used by the controller 502 in a given CNG gas filling environment. This configuration computer 514 can be a local computer, or the system network controller can effectively provide this same type of configuration remotely through the network 560 in communication with the CNG system programmable controller.

It will be appreciated by those of ordinary skill in the art that systems and methods employing the disclosed principles can be embodied in other specific forms without departing from the spirit or essential character thereof. The presently disclosed embodiments are therefore considered in all respects to be illustrative and not restrictive. The scope of the disclosed principles is indicated by the appended claims rather than the foregoing description, and all changes that come within the meaning and range of equivalents thereof are intended to be embraced therein.

For example, while the pressures described as thresholds for closing of switches when pressures drop below specified are described embodiments herein as 3600-3800 psig, but it is further understood herein and encompassed within disclosed embodiments that such pressure ranges may be broader, e.g., 3400 to 4000 psig, 3650-3750 psig, or depending on system configurations, as with the foregoing specified pressures, about 3700 psig.

The computer readable medium described herein is provided to store the computer-readable instructions used for executing the various methods described with respect to the embodiments of FIGS. 2-4. Such medium may be disk-based storage, solid state storage, magnetic media, or cloud-based or other distributed storage.

Persons skilled in the art may make various changes in the shape, size, number, and/or arrangement of parts without departing from the scope of the instant disclosure. In some embodiments, several of these components may be interchangeable and/or can be integrated with each other. Interchangeability or integrality may allow for design efficiencies and cost savings. The size or ratings of components and/or systems described herein may be scaled up or down to suit the particular design needs in an implementation. Where ranges have been provided, the disclosed endpoints may be treated as exact and/or approximations as desired or demanded by the particular embodiment.

Each disclosed method and method step may be performed in association with any other disclosed method or method step and in any order according to some embodiments. Where the verb "may" appears, it is intended to convey an optional and/or permissive condition, but its use is not intended to suggest any lack of operability unless otherwise indicated. All or a portion of the described systems may be configured and arranged to be disposable, serviceable, interchangeable, and/or replaceable. These equivalents and alternatives along with obvious changes and modifications are intended to be included within the scope of the present disclosure. Accordingly, the foregoing disclosure is intended to be illustrative, but not limiting, of the scope of the disclosure as illustrated by the appended claims.

The title, abstract, background, and summary sections, and all headers provided for all of the sections of the present document are provided to comply with patent office regulations and/or for the convenience of the reader. They include no admissions as to the scope and content of prior art and no limitations applicable to all disclosed embodiments.

What is claimed is:

1. A compressed gas fueling system for providing improved fueling operation, the compressed gas fueling system comprising:

a plurality of compressed gas dispensers for filling portable tanks brought to the fueling system for filling;

a compressed gas tank storage system;

a compressor;

a gas control network having compressed gas connections to the plurality of compressed gas dispensers, to the compressed gas tank storage system, and to the compressor, the gas control network having gas distribution controls physically capable of directing gas to one or more of the plurality of compressed gas dispensers and the compressed gas tank storage system and from one or more of the compressed gas tank storage system and the compressor;

at least one sensor operable to detect a condition when multiple portable tanks are connected to two or more dispensers of the plurality of compressed gas dispensers, the sensor further providing an output signal; and a system program controller operable to receive at least the output signal from the at least one sensor and to direct the gas distribution controls to improve the performance of the fueling operation in the condition when multiple portable tanks are connected to the two or more dispensers of the plurality of compressed gas dispensers, wherein the system program controller establishes at least one of the plurality of compressed gas dispensers as a priority gas dispenser and controls the gas control network such that a filling pressure to the priority gas dispenser is maintained at a minimum level.

2. The system of claim 1, wherein the minimum level is at least 3400 psig.

3. The system of claim 2, wherein the minimum level is at least 3600 psig.

4. The system of claim 1, wherein the minimum level is approximately 3700 psig.

5. The system of claim 1 wherein the system maintains the highest differential of pressure between the system and the priority gas dispenser without stalling another of the two or more of the plurality of gas dispensers connected to the multiple portable connected tanks.

6. The system of claim 1 wherein the system program controller receives multiple input signals including the sensor output and provides multiple output signals to control elements of the gas control network.

7. The system of claim 6 wherein at least some of the multiple input signals and the output signals are electrical signals.

8. The system of claim 6 wherein at least some of the multiple input signals and the output signals are pneumatic signals.

9. The system of claim 6 wherein at least some of the multiple input signals are handle lift signals from at least some of the plurality of compressed gas dispensers.

10. The system of claim 1 and further comprising a high-pressure storage bypass connection that is operable to be controlled to provide pressure from the compressed gas storage system in parallel to pressure from the compressor.

11. The system of claim 6 wherein at least some of the multiple input signals and the output signals are optical signals.

* * * * *